United States Patent [19]

Dizière

[11] 4,398,485

[45] Aug. 16, 1983

[54] DEVICE FOR DETACHABLY SECURING A CENTERBOARD TO A SAILBOARD OR THE LIKE

[76] Inventor: Bernard Dizière, Cholet, France

[21] Appl. No.: 236,441

[22] Filed: Feb. 20, 1981

[30] Foreign Application Priority Data

Feb. 22, 1980 [FR] France ..... 80 04133

[51] Int. Cl.[3] ..... B63B 41/00

[52] U.S. Cl. ..... 114/132; 441/79

[58] Field of Search ..... 403/361, 92, 93; 441/74, 79; 440/56; 114/127–130, 139, 39, 132, 140, 141, 162, 165; 16/227

[56] References Cited

FOREIGN PATENT DOCUMENTS 491811 3/1977 Australia ..... 441/79

2706141 8/1978 Fed. Rep. of Germany ..... 114/132

*Primary Examiner*—Sherman D. Basinger

*Attorney, Agent, or Firm*—Frost & Jacobs

[57] ABSTRACT

The device comprises a casing adapted to be secured, as by gluing, to the sailboard, the casing having a downwardly opening, mortise-defining recess surrounded at its lowermost end by a peripheral flange, the centerboard having a tenon at its upper end adapted to be received in the mortise, the centerboard having a shoulder at its front end adapted to engage the peripheral flange, the tenon terminating rearwardly in an outwardly opening bore having resilient lips adapted to be snap-fitted around a hinge pin extending horizontally between the opposite sides of the mortise, the mortise including a self-locking attachment adjacent its front end releasably engagable with the front end of the tenon to secure the centerboard in the mortise in its normal position of use, the centerboard being readily inserted in and removed from the mortise and pivotable about the hinge pin if it strikes an obstruction.

4 Claims, 9 Drawing Figures

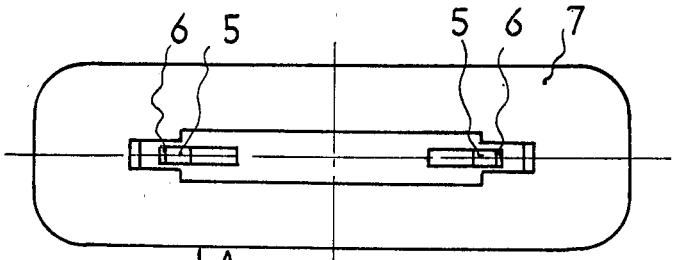
Fig.4
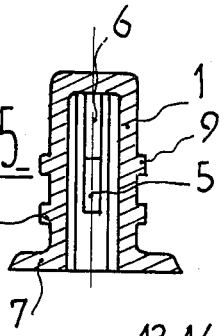
Fig.5
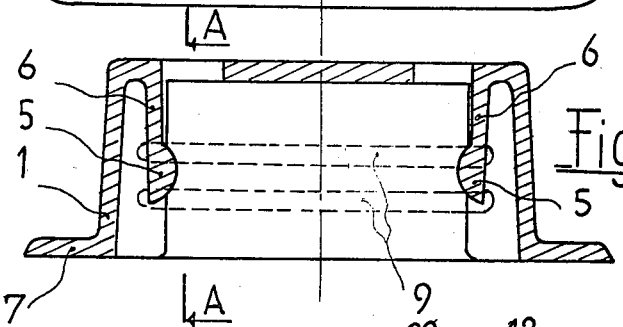
Fig.3
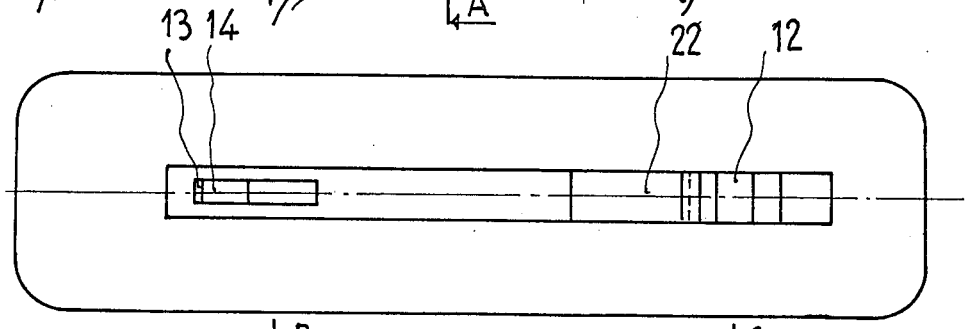
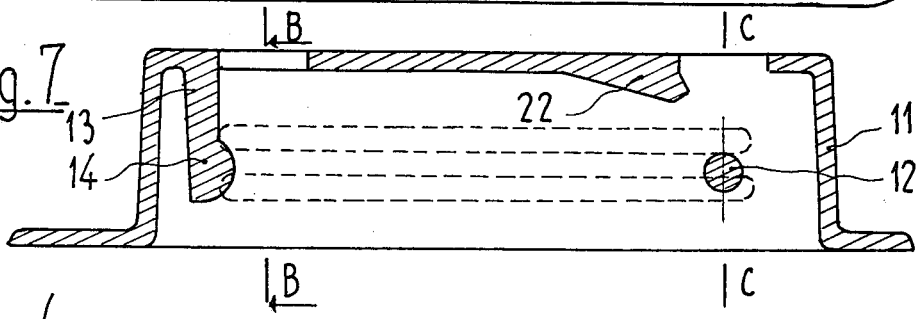
Fig.7
Fig.6
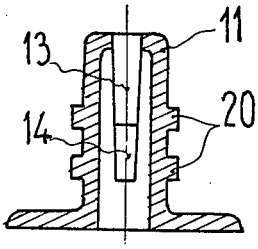
Fig.8
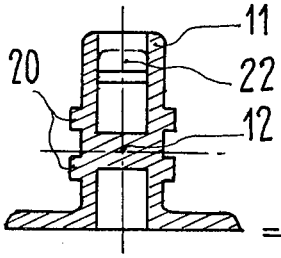
Fig.9

DEVICE FOR DETACHABLY SECURING A CENTERBOARD TO A SAILBOARD OR THE LIKE

The present invention relates to devices for setting a fin or a centerboard in the structure of a sailboard.

A sailboard or surfboard of conventional character consist of a low-draught hull akin to a board a few centimeters thick and so configured as to include a stem. This board consists of a core of foamed polyurethane sandwiched between an upper side and a lower side formed of polyester glass fiber. The elements equipping the board are limited to a mast, a sail, a wishbone, and a centerboard or fin. In particular, the fin is set by means of a tenon the upper end of which is located in a longitudinal mortise provided for this purpose on the lower side of the board, retention of the fin in its recess being effected by means of two rubber plugs inserted between the longitudinal sides of the tenon and the mortise, the resiliency of the material providing permanent contact pressures between the assembled parts. However, this mode of attachment does not thereby impart rigidity to the assembly; the result is the risk of losing the fin under the mere action of waves and still more unavoidably when the latter contacts an obstacle or the sand at the time when the board reaches the beach.

SUMMARY OF THE INVENTION

Devices, according to the invention avoid these drawbacks by effecting sufficiently rigid setting of the fin in the board during sailing while allowing retraction of said fin or said drift under the board in case of impingement against an obstruction without risk of damage to the board, the fin-to-board or centerboard-to-board connection being adapted to be maintained after the impact, said device moreover allowing quick setting or removal of the fin or centerboard.

The device which is the object of the invention consists of a housing or casing adapted to be embedded by gluing in a recess provided for this purpose in the board structure, said casing including resilient retaining means and a hinge-point cooperating with corresponding means provided on the tenon of the fin or the centerboard. Thus, the casing has a recess forming a mortise at least one end of which has a resilient tongue or finger fitting into a socket provided in at least one of the vertical edges of the tenon. The sides of the tenon laterally mate the mortise sides. In place of an end tongue there may be substituted a hinge consisting of an horizontal transverse pin extending between the two mortise sides and about which the fin rocks to become retracted rearwards of the board, the setting or removal of the fin from said pin being effected by a snap action.

The invention thus relates to a device for securing a fin or a centerboard which allows retraction of the latter in case of an impingement against an obstruction, without risk of damage to the board. This securing device is characterized in that it includes two elements only, a casing having a peripheral flange forming a bearing surface and defining a mortise-forming element, and a tenon-shaped portion integral with the fin. The casing, which is preferably made of one single part, has two retaining means integral with said casing. At least one of the retaining means is a resilient tongue which retains the fin in position by cooperating with a socket formed on the fin tenon. The other retaining means is either another resilient tongue which is also integral with the casing, or a pivot-pin to which two lips mounted on the tenon are resiliently engaged. In this manner, under the action of an impact, the fin is removed from the front resilient tongue of the casing. Moreover, typically, the fin is removable and can be withdrawn from the casing, for instance during transport.

The present invention therefore has for its object a device for securing a fin or a centerboard on a sailboard, allowing retraction of the fin or the centerboard in case of impingement against an obstruction without risk of damage to the board, said device being characterized in that it includes a casing intended to be incorporated in the structure of the sailboard by gluing onto the latter, the casing including at its bottom a peripheral flange intended to form a bearing surface and defining a mortise-forming longitudinal recess having fitted therein a tenon-forming portion of the fin or the centerboard, this tenon-forming portion having a shoulder intended to abut on the peripheral flange of the casing, the latter moreover including, at the mortise ends, two retaining means integral with the casing and whereof at least one is a resilient tongue intended to be inserted in a socket formed on the tenon of the fin or the centerboard, so that the tongue resiliency ensures assembly by snap action of the fin or the drift.

Further advantages and features of the present invention lie in that:

the second retaining means is another resilient tongue intended to be inserted in another socket formed on the tenon of the fin or the centerboard;

the second retaining means is a pin integral with the casing and which permits rocking of the fin or the centerboard;

the corresponding end vertical edge of the fin or centerboard tenon has, a bore which opens outwardly through two lips so spaced as to permit forcible passage of the hinge-pin, said bore being surrounded by two resiliency slots in such manner that the two lips form a resilient clamp facilitating insertion and removal of the fin or drift;

the casing includes a nose at the top of the mortise engagable by a lug on the upper end of the tenon when the fin rocks rearwardly about the hinge-pin upon impingement against an obstruction;

the casing and its two retaining means are integral.

DESCRIPTION OF THE DRAWINGS

The appended drawings illustrate, by way of examples, two embodiments of the device according to the present invention; wherein:

FIG. 3 is a longitudinal sectional view along the axis of the casing shown in FIG. 1;

FIG. 4 is a bottom plan view of the casing shown in FIG. 1;

FIG. 5 is a transverse sectional view along the line A—A, of FIG. 3;

FIG. 6 is a longitudinal sectional view along the axis of the casing shown in FIG. 2;

FIG. 7 is a bottom plan view of the casing shown in FIG. 6;

FIG. 8 is a transverse sectional view taken along the line B—B of FIG. 6.

FIG. 9 is a transverse sectional view taken along C—C of FIG. 6.

DESCRIPTION OF THE PREFERRED EMBODIMENTS

Figure 1:
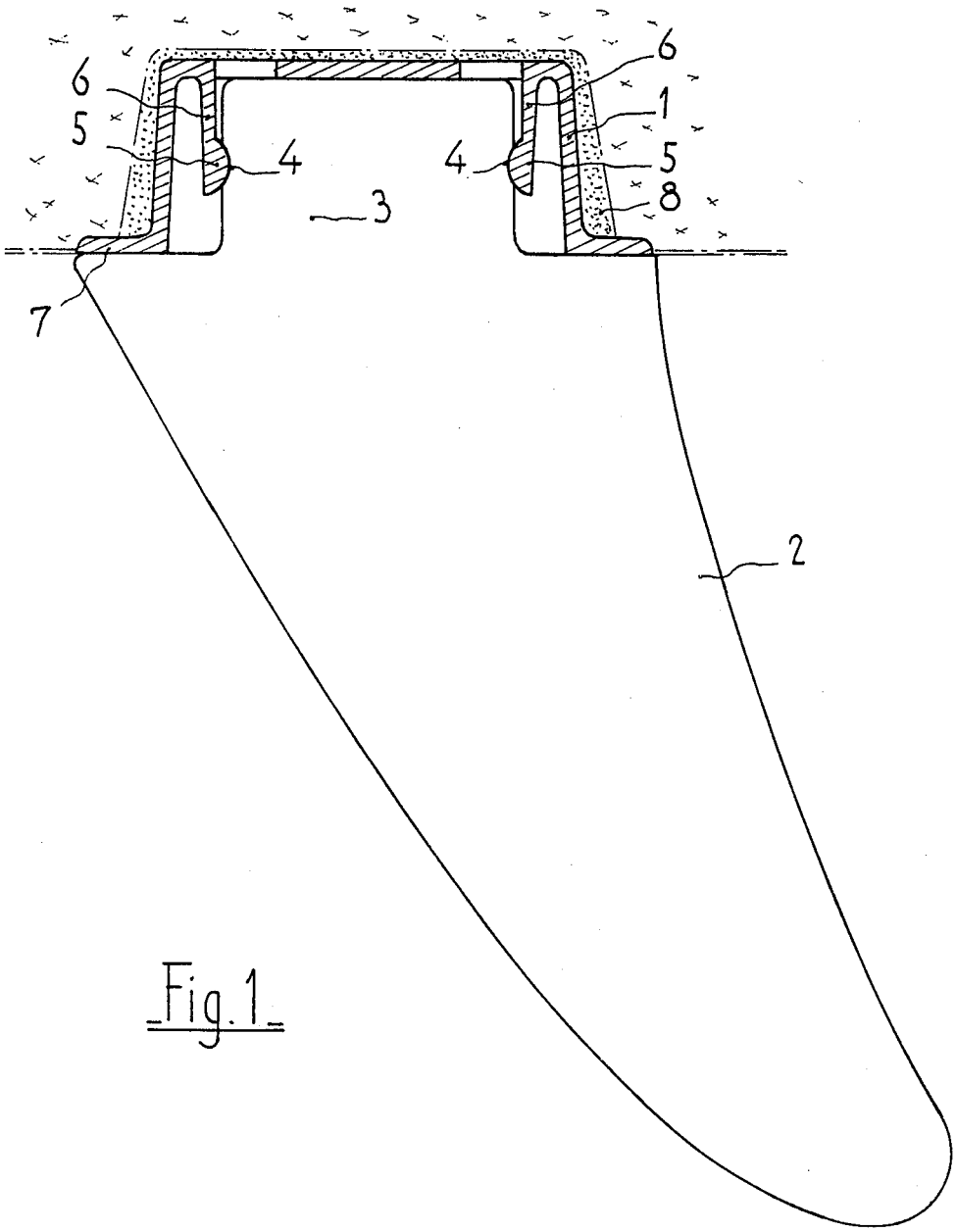
FIG. 1 is a longitudinal sectional view of an embodiment according to which a fin is set in a casing provided with two retaining tongues.

As shown in the embodiment of FIG. 1, the device is composed of a casing 1 made of polyacetal plastics, the details of which are illustrated in FIGS. 3, 4 and 5, and a fin 2 made of polyamide plastics, the assembly thereof being effected by snap action. The fin includes for this purpose a tenon 3 the thickness of which mates, within tolerances, with the breadth of the mortise-forming casing 1, the end vertical edges of tenon 3 each having a semispherical socket or indentation 4 within which are fitted, in the assembled position, the ends 5 of the two resilient tongues 6 which project downwardly from the base of the casing and which spread apart when the tenon 3 is inserted into the casing, the terms engaging the socket 4 in the assembled position so as to maintain sufficient contact pressures to insure stability of the assembly during sailing. This stability is enhanced by the magnitude of the surfaces of the fin which bears on the casing. The casing is constructed in the form of a hollow frustum of a pyramid having at its bottom a peripheral flange 7 which acts as a bearing for the fin and prevents sinking of the casing into the foam polyurethane from which the sailboard is formed in the case of impingement of the fin against an obstruction, when the latter has caused deterioration of the polyester skin of the board. The fitting of the casing to the sailboard is effected by gluing the latter in a recess 8 provided in the board, the outer side of the flange 7 being located in the lower plane of the board, the longitudinal outer sides of the casing having anchor forming ribs 9 (seen in FIG. 5) which ensure perfect casing-to-board bonding upon complete setting of the glue.

Figure 2:
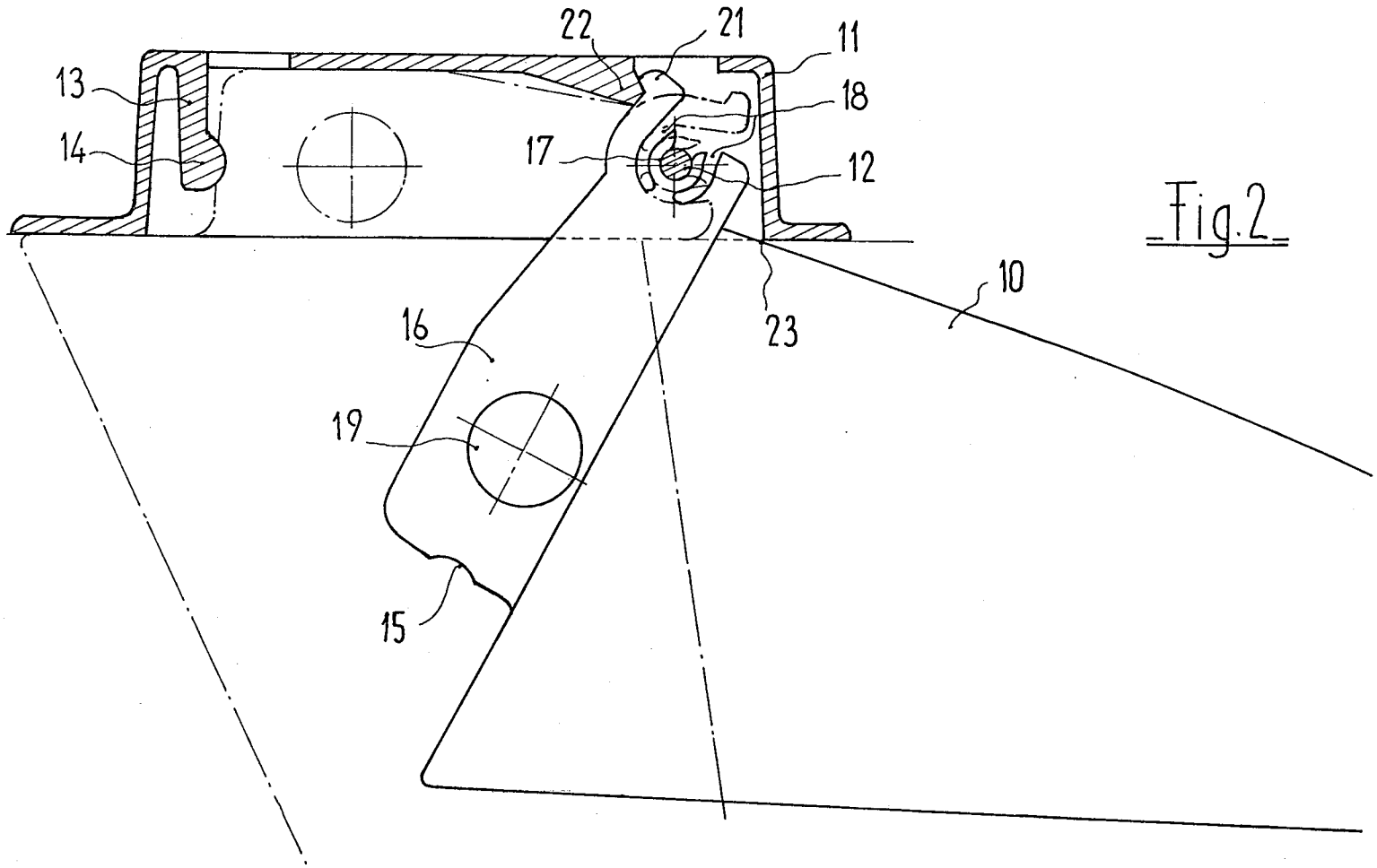
FIG. 2 is a longitudinal sectional view of an embodiment according to which a fin is set into a casing provided with a single retaining tongue and a hingepoint allowing rearward rocking of the fin.

In the embodiment illustrated in FIG. 2, the fin can be retracted towards the rear of the board while remaining connected to the latter in case of impingement against an obstruction, this retracted position being shown in full lines. In the assembled position shown in chain-dotted lines, the fin 10 is retained in the casing 11 by being snapped around a horizontal hinge-pin 12 connecting the longitudinal sides of the mortise and located about half way up the latter and by the resilient action of a tongue 13, which projects downwardly within the recess in the casing and has its end 14 fitted into a socket 15 provided on the end vertical edge of the tenon 16. The other end vertical edge of the tenon comprises an outwardly opening circular bore 17 having opposing lips so spaced as to allow forcible passage of the casing hinge-pin 12 therebetween to position the pin in the bore. Two resiliency slots 18 surround the bore an coact with it to form a sort of resilient clamp facilitating the fin insertion and removal into and from the casing recess. An aperture 19 is provided in the tenon for finger passage to facilitate the fin removal; FIGS. 6, 7, 8 and 9 illustrate details of casing 11; the assembling clearances for the tenon and the mortise are identical to that provided in the first embodiment. Similarly, the longitudinal outer sides of the casing also have ribs 20 effecting anchorages which ensure perfect bonding during the gluing of the casing and the board.

To prevent the fin from being lost after having rocked rearwards about pin 12 under the effect of an impact, tenon 16 includes in its upper portion a lug 21 which comes in abutment against a butt or nose 22 located at the upper end of the mortise. This arrangement prevents uncoupling between the resilient clamp and the hinge-pin when the rear edge of the fin abuts the edge 23 defining the end of the casing mortise.

The two described embodiments permit the fin to be instantaneously installed in a stable manner, and they also permit the fin to be rapidly disassembled, thereby facilitating the transportation of the sailboard. The pivotal movement of the fin avoids the risk of losing it during sailing or when approaching the beach.

What I claim is:

1. A device for detachably mounting a centerboard on a sailboard or the like, said device comprising a casing adapted to be adhesively secured to the sailboard, said casing having an elongated downwardly opening recess therein defining a mortise having front and rear walls and opposing side walls, a peripheral flange surrounding the lowermost end of said recess, said flange being adapted to be seated on the undersurface of the sailboard to provide a bearing surface, a centerboard having a tenon forming portion at its upper end of a size to be fitted in the recess in the casing and a forwardly projecting shoulder adapting to seat on said peripheral flange, said tenon having front and rear ends, a horizontally disposed hinge pin extending between the opposite side walls of the mortise adjacent its rear end and intermediate its top and bottom, said tenon terminating rearwardly in an outwardly opening bore having an opposing pair of resilient lips adapted to be snap-fitted around said hinge pin to permit rearward pivotal movement of said centerboard relative to said mortise, and self-locking attachment means adjacent the front end of said mortise releasably engagable with the front end of said tenon to secure the centerboard in the mortise in its normal position of use, whereby the centerboard may be readily inserted in and removed from the sailboard and pivoted rearwardly about the hinge pin if it strikes an obstruction.

2. A device according to claim 1 wherein said resilient lips are integrally formed in said tenon and are defined by opposed curved slots in said tenon.

3. The device according to claim 1 including a lug on the upper rear end of said tenon engagable with a stop-forming nose at the upper end of said mortise when said centerboard is pivoted rearwardly, said lug and said nose preventing removal of the centerboard when in its rearwardly pivoted position.

4. A device according to any one of claims 1, 2 or 3 wherein said self-locking attachment means comprises a resilient tongue projecting downwardly into the recess in said mortise adjacent its front end, said tongue having a projection thereon engagable with a depression in the front end of said tenon when said tenon is seated in said mortise.

* * * * *